United States Patent [19]

Hilterhaus

[11] 4,059,659

[45] Nov. 22, 1977

[54] PROCESS FOR PRODUCING FINISHED AND/OR IRREVERSIBLY EMBOSSED MICROPOROUS SHEET STRUCTURES

[75] Inventor: Karl Heinz Hilterhaus, Georgsmarienhutte, Oesede, Germany

[73] Assignees: Chemie-Anlagenbau Bischofsheim GmbH; Reuter Technologie GmbH, both of Germany

[21] Appl. No.: 624,892

[22] Filed: Oct. 22, 1975

[51] Int. Cl.[2] ..... B29D 27/04; B32B 3/30; B32B 31/12

[52] U.S. Cl. ..... 264/45.3; 260/2.5 AY; 264/41; 264/134; 264/331; 264/DIG. 77; 427/246; 427/276; 427/278; 428/151; 428/320; 428/904

[58] Field of Search ..... 264/41, 45.3, 134, 41, 264/321, 331; 260/2.5 AY; 428/151, 320, 904, ; 427/246, 276, 278

[56] References Cited

U.S. PATENT DOCUMENTS

| | | | |
|---|---|---|---|
| 3,625,871 | 12/1971 | Traubel et al. | 264/41 X |
| 3,645,775 | 2/1972 | Schulze et al. | 260/2.5 AY X |
| 3,681,125 | 8/1972 | Traubel et al. | 264/41 X |
| 3,687,715 | 8/1972 | Kigane et al. | 260/2.5 AY X |
| 3,689,629 | 9/1972 | Hull | 264/48 X |
| 3,763,301 | 10/1973 | Civardi et al. | 264/41 X |
| 3,769,381 | 10/1973 | Konig et al. | 264/41 |
| 3,931,437 | 1/1976 | Civardi et al. | 427/246 |

*Primary Examiner*—Philip Anderson
*Attorney, Agent, or Firm*—Larson, Taylor and Hinds

[57] ABSTRACT

This invention relates to a process for producing finished and/or irreversibly embossed microporous sheet structures by coagulation of a polyurethane solution, in which prior to the coagulation of the polyurethane solution a finishing agent is mixed into it or a finishing agent is applied to the free surface of the polyurethane solution which has been spread out flat and embossing is then carried out during or shortly after the coagulation or after the washing, but still before the drying, or else the microporous sheet structure obtained and into which the finishing agent has been mixed previously is, after drying, pressed between two plates or passed under pressure between at least two oppositely rotating rolls, at least one of which is highly polished.

18 Claims, No Drawings

PROCESS FOR PRODUCING FINISHED AND/OR IRREVERSIBLY EMBOSSED MICROPOROUS SHEET STRUCTURES

The present invention relates to a process for producing finished and/or irreversibly embossed microporous polyurethanebased sheet structures.

It is known to finish and/or emboss microporous sheet structures of polyurethanes, which have been obtained by coagulation of corresponding polyurethane solutions, after the drying thereof.

According to the invention, it has been found, surprisingly, that the finishing can already be dealt with prior to the coagulation and that the coagulated and washed material can already be embossed prior to the drying, irrespective of whether finishing has been carried out beforehand or not. Moreover, in the process according to the invention, by working a finishing agent into the polyurethane solution to be coagulated, a product resembling patent leather can be obtained after the production and drying of the microporous sheet structure by simply pressing between two plates or passing the sheet structure between oppositely rotating rolls, at least one of which is polished to a high brilliancy.

Consequently, the invention relates to a process for producing finished and/or irreversibly embossed microporous sheet structures by coagulation of a polyurethane solution which is characterised in that prior to the coagulation of the polyurethane solution a finishing agent is mixed into it or a finishing agent is applied to the free surface of the polyurethane solution which has been spread out flat and embossing is then carried out during or shortly after the coagulation or after the washing, but still before the drying, or else the microporous sheet structure obtained and into which the finishing agent has been mixed previously is, after drying, pressed between two plates or passed under pressure between at least two oppositely rotating rolls, at least one of which is highly polished.

The preferred embodiments resulting from the definition of the invention given above are apparent in particular from sub-claims 2 to 8 which are at the end of this description and to which reference is expressly made at this point.

In the production of a product resembling patent leather, the "embossing" must be carried out after the drying, it being necessary to understand by embossing the exertion of pressure by a highly polished surface at elevated temperature up to 150° C. The pressure exerted on the material to be embossed may be produced between two plates or two oppositely rotating rolls, at least one of which is polished to a high brilliancy. The polyurethane solution used in this case contains in addition the oils, fats and/or waxes mentioned in sub-claim 7 and is applied in a layer thickness which ensures the creation of a smooth surface.

The oils, fats and waxes mentioned in claim 7 may also be worked into the polyurethane solution to be coagulated in the other embodiments according to the invention, but they do not then have any extraordinary effect.

Consequently, according to the invention, there are more particularly made available improved processes for the production of microporous sheet structures, in particular artificial leather materials, wherein the finishing already takes place during the production of the microporous sheets and, in the case of the production of high-lustre patent leather, the formerly usual subsequent application of the high-lustre producing sprayed film, which would moreover destroy the permeability to water vapour, is saved.

It is significant that in the process according to the invention the microporosity is not destroyed and, as far as is applicable, the graining obtained by means of the embossing cannot be taken out mechanically. Moreover, the process represents a substantial simplification of the manufacture of artificial leather, since the conventional finishing machines, for example spraying equipment and drying ovens, are no longer necessary.

The same advantages are also obtained in the embodiment according to the invention in which the essential feature resides in the spraying-on of a finishing solution which preferably represents a dilute coating solution (the polyurethane solution to be coagulated, also called the end solution), which has a different colour tone to the coating solution merely in order to achieve special colour effects. Generally, it can be said that the polyurethane solution spread out flat and to be coagulated should be dyed lighter than the finishing solution. The pigments and the pigment concentrations which are chosen are such as result in a colour shift during the embossing operation as a result of pressure, temperature and contact time.

Artificial leathers which are produced by this method show a colour shift similar to natural leather even without embossing.

In the carrying into effect of the process according to the invention, use is made in particular of such polyurethane solutions (end solutions) as are described in German Laid-open patent specification No. 2,355,073 and in German patent application Nos. P 24 60 764.5 and P 24 60 835.3. Polyurethane solutions which are preferably used are described in sub-claims 9 to 17 hereinafter.

The coagulating bath preferably consists of water, it being possible to introduce the polyurethane solution which is spread out flat into the coagulating bath without previous gelling.

The following Examples illustrate the invention without, however, confining it to them.

EXAMPLE 1

This Example illustrates the embodiment according to the invention in which embossing is carried out (without previous finishing) prior to the drying of the coagulated material.

a. Preparation of the polyurethane solution to be coagulated 2.04 mols of 4,4'-diphenylmethane diisocyanate are introduced with dimethylformamide in 70% solution at 40° C into a dry stirring reaction vessel under a nitrogen atmosphere.

One mol of a polyester in a 70% dimethylformamide solution, which polyester is prepared from adipic acid and hexane-1,6-diol with a hydroxyl number of 139.5, is added continuously in the course of half an hour at a reaction temperature of 65° C ± 2° C. An NCO preadduct solution which is stable for weeks and having an NCO content of 2.5–3.0% is formed.

3100 parts by weight of dimethylformamide, 1800 parts by weight of a 10% lamp black dispersion (Printex U of the firm Degussa) and 50 parts by weight of hydrazine hydrate are placed in a stirring apparatus equipped with a vaned stirrer and so much of the above-mentioned NCO preadduct solution is added until the viscosity values measured indicate a value at which the addition of a further very small amount of NCO preadduct solution would result in immediate gelling, i.e. a honey-like mass which contains about 30% of solids has been formed. This mass constitutes the polyurethane solution (also called end solution) to be coagulated.

b. Preparation of the substrate on which the polyurethane solution to be coagulated is to be applied and then coagulated A needled and shrunk commercially available raw fleece with a weight per unit area of about 650 g/m² is immersed in a solution prepared in accordance with Example 1 (a) and then diluted to 15% until it has absorbed 80% of solids.

The fleece impregnated in this way is coagulated in hot water and freed from the solvent. Drying is then carried out at 130° C. The dried material is split into layers 1 mm thick on a splitting machine and buffed on a buffing machine with fine abrasive paper. A substrate is obtained which is suitable for artificial leather and which is further worked up as indicated in section (c).

c. Application of the polyurethane solution to be coagulated to the substrate with subsequent coagulation and embossing prior to drying A bubble-free solution according to Example 1 (a) is applied with a doctor blade in a layer thickness of 1.5 mm to the substrate prepared according to Example 1 (b). The coated substrate is so dipped into water which is at a temperature of about 85° C that during the coagulating operation the material comes into contact with the coagulating bath only from the top. The solvent is then washed out and the material is embossed by means of an embossing device provided with a leather grain. The linear pressure is so adjusted at a temperature of about 60°–150° C that, with the chosen contact time, an irreversible grain pattern such as is known from real leather is embossed. After the following drying operation, an artificial leather product is obtained which has a high water absorbing capacity and good permeability to water vapour. The product does not need to be further finished as is otherwise usual.

EXAMPLE 2

This Example illustrates the production of a colour contrast by embossing prior to drying (without previous finishing).

a. The polyurethane solution to be coagulated is prepared as described in Example 1 (a), but with the difference that instead of the 1800 parts by weight of the 10% lamp black dispersion a mixture consisting of the following colouring pigments is used:

| | | |
|---|---|---|
| 260 | parts by weight of molybdenum orange pigment | 75% in PVC<br>20% in DMF |
| 508 | parts by weight of sulphur-containing yellow pigment about | 40% in PVC<br>20% in DMF |
| 25 | parts by weight of lamp black pigment about | 10% in PVC<br>20% in DMF |

A brown viscous mass with about 30% of solids is obtained.

b. The preparation of the substrate is effected likewise as indicated in Example 1 (b), but with the difference that the polyurethane solution according to Example 2 (a) is used for impregnation. A brown leather-like substrate is obtained.

c. The brown substrate is coated with the polyurethane mass of Example 2 (a) in a layer 1.5 mm thick and is worked up further as in Example 1 (c).

By embossing with a fine and/or coarse grain, a product which has leather-like colour shifts is obtained. The colour contrast becomes all the greater the higher the temperature and/or the pressure and/or the longer the time of contact with the grain roll.

EXAMPLE 3

This Example shows the finishing prior to coagulation with or without embossing prior to drying.

A coated substrate is prepared as in Example 2, but with a coating thickness of only 0.8 mm. Prior to coagulation, the coated substrate is sprayed with one of the following spraying solutions from a spray gun.

For preparing the spraying solutions, the following stock solution is first prepared:

About 81 parts by weight of preadduct (NCO content from 2.5 to 3.0%, prepared as described in Example 1 (a)) are added to a mixture of 123 parts by weight of dimethylformamide, 5 parts by weight of glycerine and 2 parts by weight of hydrazine hydrate (100%), the increase in viscosity being recorded. The solution is diluted to a solids content of 10%. The stock solution obtained in this way is stable and is worked up further into various spraying solutions to produce different kinds and nuances of smell, colour and handle, for example it is worked up into the following colour and smell spraying solutions:

a. Colour spraying solutions:

(a') Brown: 50 parts by weight of the stock solution, 1 part by weight of "Hostaperm" organic brown pigment manufactured by Hoechst (a'') Brown: 50 parts by weight of the stock solution, 2 parts by weight of Samaronbraun (organic brown dye manufactured by Hoechst), 0.5 part by weight of cod-liver oil +, 2 parts by weight of propoxylated nitrogen-containing phenolformaldehyde resin with a hydroxyl number of about 530.

b. Colour and smell spraying solution:

Bordeaux: 50 parts by weight of the stock solution 1 part by weight of castor oil +, 1 part by weight of mimosa extract ++, 5 parts by weight of Mikrolith-bordeaux R-K (organic pigment preparation manufactured by Ciba).

+ Other oils and fats which can be used are oils and fats as used in the leather industry, for example tallow, beeswax, paraffin, ceresin, stearin, linseed oil, neat's-foot oil, olive oil, rapeseed oil, cottonseed oil, insect wax, wool grease, carnauba wax, montan wax and their sulphonated products and also mixtures of the above-mentioned compounds.

++ Basically, other tanning extracts may also be used. These are all natural and synthetic materials of a predominantly organic nature giving off the typical smell of leather, for example extracts of tanning timbers, such as oak, chestnut, quebracho, extracts of tanning fruits, such as dividivi, valunea, algarobilla, synthetic compounds of the class of the condensation products from phenols, phenolsulphonic acids, resorcinol, formaldehyde and aliphatic and aromatic amines, as well as mixtures thereof.

The substrate obtained according to Example 3 (a) is sprayed with one of the above-indicated spraying solutions prior to coagulation. The substrate sprayed in this way is coagulated at about 85° C in hot water and, after the solvent has been washed out, is dried with or without a subsequent embossing operation. Leather-like materials with bright colour shadings on a plain or grained surface are obtained which, if they have been sprayed with the spraying solution according to Example 3 (b), emit a leather-like smell.

EXAMPLE 4

This Example illustrates the production of a high-lustre effect by means of additions in the coating composition.

As in Example 1, a substrate is coated with a polyurethane solution in a layer 1.5 mm thick, 1200 parts by weight of modified castor oil with a viscosity of 45 cP having been previously added to the solution.

After coagulation, washing and drying, the material is drawn between oppositely rotating highly polished rolls under light pressure at about 150° C. A material resembling patent leather with a high glaze or lustre and a permeability to water vapour of 1 mg $cm^{-2}h^{-1}$ according to I.U.P./15 is produced.

What we claim is:

1. In a method of producing microporous sheet structure having the appearance of artificial leather by coagulation of a polyurethane solution in which a coagulatable polyurethane solution is coagulated, washed, and dried, and in which a finishing agent for making artificial leather is utilized for making a leather appearance, the improvement wherein the polyurethane solution is spread out flat such that it has a free upper surface and wherein said finishing agent for making artificial leather is applied to the free surface of the polyurethane solution which has been spread out flat and before coagulation thereof to achieve a leather appearance without a subsequent finishing step.

2. An improved method according to claim 1 wherein the sheet structure is embossed before drying.

3. An improved method according to claim 2 wherein the sheet structure is embossed during coagulation.

4. An improved method according to claim 2 wherein the sheet structure is embossed after coagulation.

5. An improved method according to claim 1 wherein said finishing agent is applied to said flat surface by applying thereto a further polyurethane solution containing a finishing agent for making artificial leather.

6. An improved method according to claim 5 wherein said leather finishing agent of said further polyurethane solution contains a coloring agent.

7. An improved method according to claim 5 wherein said leather finishing agent of said further polyurethane solution contains an agent imparting a leather-like smell.

8. An improved method according to claim 5 wherein said leather finishing agent of said further coagulatable polyurethane solution contains a material which produces characteristics affecting the handling quality of said artificial leather.

9. An improved process according to claim 1 wherein said polyurethane solution comprises an end solution in which a. an NCO preadduct is provided in a suitable solvent and then b. so much of the NCO preadduct solution is mixed continuously within a certain space of time, with constant measurement of the viscosity, into a previously prepared solution of a suitable solvent and hydrazine and/or hydrazine derivatives and/or diamines and/or polyols, it being necessary in the event of only two hydrogen atoms active according to Zerewitinow being present in these compounds to use in addition such a compound which contains at least three differently active hydrogen atoms according to Zerewitinow, until the viscosity is in a range in which even the addition of ever smaller amounts of NCO preadduct solution causes an ever greater increase in viscosity, until finally the viscosity has reached a value — and the addition of the NCO preadduct solution must then be broken off at the latest — at which the addition of a further very small amount of NCO preadduct solution would result in immediate gelling, the addition of the NCO preadduct solution being effected at such a rate that the end solution has a solids content between 15 and 35% by weight.

10. An improved process according to claim 9 wherein an NCO preadduct solution is used which has a solids content between 60 and 80% by weight.

11. An improved process according to claim 9 wherein the NCO preadduct in solution contains 1.5 to 5% of free isocyanate groups.

12. An improved process according to claim 9 wherein a solution containing hydrazines and/or dihydrazine compounds and/or diamines is used which contains the hydrazines and/or dihydrazine compounds and/or diamines in a concentration of 0.02 to 0.05 mol %.

13. An improved process according to claim 9 wherein the solvent used is a highly polar solvent, preferably an organic solvent, in particular dimethylformamide.

14. An improved process according to claim 9 wherein a hydrazine solution is used which is prepared from hydrazine hydrate and dimethylformamide.

15. An improved process according to claim 9 wherein a hydrazine solution is used and wherein the solutions are reacted at a temperature between 20° and 40° C, in particular between 25° and 35° C.

16. An improved process according to claim 9 wherein the hydrazines and/or dihydrazine compounds and/or diamines are used in a stoichiometric excess or deficiency with respect to the isocyanate groups present and, in the case of a deficiency, substances are added to the solution which contain at least two groups having active hydrogen atoms, these substances being used in excess.

17. An improved process according to claim 9 wherein substances having a cross-linking action, are dissolved in addition in the solution containing the hydrazines and/or dihydrazine compounds and/or diamines, and before this solution is used, at least one member selected from the group consisting of fillers, organic pigments, inorganic pigments, dyes, optical brighteners, UV absorbing agents, antioxidants and substances having a supplementary cross-linking action are added thereto.

18. An improved process according to claim 9 wherein the coagulating bath comprises water, and wherein the polyurethane solution which is spread out flat is introduced into the coagulating bath without previous gelling.

* * * * *

UNITED STATES PATENT AND TRADEMARK OFFICE

CERTIFICATE OF CORRECTION

PATENT NO. : 4,059,659

DATED : November 22, 1977

INVENTOR(S) : Karl Heinz Hilterhaus

It is certified that error appears in the above-identified patent and that said Letters Patent are hereby corrected as shown below:.

In the heading insert:

Claims priority of British application Serial No. 47370/74 filed November 1, 1974 and German application Serial No. 25 22 019 filed May 17, 1975.

Signed and Sealed this

*Sixteenth* Day of *May 1978*

[SEAL]

*Attest:*

RUTH C. MASON
*Attesting Officer*

LUTRELLE F. PARKER
*Acting Commissioner of Patents and Trademarks*

UNITED STATES PATENT AND TRADEMARK OFFICE

CERTIFICATE OF CORRECTION

PATENT NO. : 4,059,659

DATED : November 22, 1977

INVENTOR(S) : Karl H. Hilterhaus

It is certified that error appears in the above-identified patent and that said Letters Patent are hereby corrected as shown below:

Column 1, line 55, delete "the".

Column 1, lines 55 and 56, delete "mentioned in sub-claim 7" and insert --(castor oil, tallow, beeswax, paraffin, ceresin, stearin, linseed oil, neat's foot oil, olive oil, rapeseed oil, cottonseed oil, insect wax, wool grease, carnauba wax, montan wax and their sulphonated products or mixtures thereof)--.

Column 1, line 58, delete "in claim 7" and insert --above--.

Signed and Sealed this

*Eighteenth* Day of *July 1978*

[SEAL]

*Attest:*

RUTH C. MASON
*Attesting Officer*

DONALD W. BANNER
*Commissioner of Patents and Trademarks*